US008056242B2

(12) United States Patent
Chen

(10) Patent No.: US 8,056,242 B2
(45) Date of Patent: Nov. 15, 2011

(54) MULTI-USE HAND TOOL

(76) Inventor: Kung-Chen Chen, Taichung Hsien (TW)

( * ) Notice: Subject to any disclaimer, the term of this patent is extended or adjusted under 35 U.S.C. 154(b) by 532 days.

(21) Appl. No.: 12/289,646

(22) Filed: Oct. 31, 2008

(65) Prior Publication Data

US 2010/0107418 A1 May 6, 2010

(51) Int. Cl.
*B25G 3/00* (2006.01)

(52) U.S. Cl. ..... 30/342; 30/340

(58) Field of Classification Search ..... 30/342, 30/340, 144, 2, 329; 83/698.11
See application file for complete search history.

(56) References Cited

U.S. PATENT DOCUMENTS

| | | | | | |
|---|---|---|---|---|---|
| 1,866,529 | A * | 7/1932 | Farkas | 30/392 |
| 3,080,653 | A * | 3/1963 | Dolin | 30/317 |
| 3,367,335 | A * | 2/1968 | Ward et al. | 606/167 |
| 3,621,899 | A * | 11/1971 | Hula | 30/280 |
| 3,927,893 | A * | 12/1975 | Dillon et al. | 279/75 |
| 3,964,163 | A * | 6/1976 | Russo | 30/166.3 |
| 4,817,284 | A * | 4/1989 | Sacherman et al. | 30/329 |
| 4,985,034 | A * | 1/1991 | Lipton | 606/167 |
| 5,494,298 | A * | 2/1996 | Maleski | 473/584 |
| 5,657,541 | A * | 8/1997 | Hickok et al. | 30/123 |
| 5,782,853 | A * | 7/1998 | Zeevi et al. | 606/187 |
| 5,867,912 | A * | 2/1999 | Hickok et al. | 30/329 |
| 6,546,633 | B1 * | 4/2003 | Lovell et al. | 30/517 |
| 6,751,875 | B2 * | 6/2004 | Jones | 30/392 |
| 7,937,840 | B2 * | 5/2011 | Chen | 30/337 |
| 2001/0000833 | A1 * | 5/2001 | Chen | 30/254 |
| 2003/0079353 | A1 * | 5/2003 | Lovell et al. | 30/392 |
| 2003/0188434 | A1 * | 10/2003 | Chiu | 30/144 |
| 2008/0110033 | A1 * | 5/2008 | Peterson et al. | 30/329 |

* cited by examiner

*Primary Examiner* — Sean Michalski
(74) *Attorney, Agent, or Firm* — Bacon & Thomas, PLLC

(57) ABSTRACT

A hand tool for a craft knife has a handle, a blade tray and a connector. The handle has a mounting chamber, a mounting tube, a cap, a socket bit and an ejector tube. The blade tray is mounted in the mounting chamber and the mounting tube of the handle and has a base and a casing. The base has two mounting protrusions formed on an internal surface of the base. The casing is pivotally mounted in the base and has two mounting holes and a blade chamber. The connector is detachably connected to the handle and has a socket bar, a clamping tube and a pressing tube. The socket bar is detachably mounted in the socket bit. The clamping tube is mounted securely in the socket bar. The pressing tube is mounted around the clamping tube and presses against the socket bar and the clamping tube.

18 Claims, 7 Drawing Sheets

MULTI-USE HAND TOOL

BACKGROUND OF THE INVENTION

1. Field of the Invention

The present invention relates to a hand tool, and more particularly to a multi-use hand tool for a craft knife.

2. Description of Related Art

A conventional craft knife has a handle and a blade box. The handle has a front end, a rear end, a connector, a blade and a cover. The connector is mounted on the front end of the handle and comprises a mount and an annulus. The mount is tapered and has a slot and a thread. The annulus is rotatably mounted around the mount. The blade is detachably mounted in the slot of the connector. The cover is detachably mounted around the connector to cover the knife blade. The blade box is separately disposed for storage of replacement blades to prevent the blades from being lost, damaged or causing injury.

When the blade requires changing, the annulus is rotated, allowing the slot to open and release the blade from the connector to allow a replacement blade from the blade box to be mounted in the slot of the connector and held securely by rotation of the annulus. However, the blade box is separated from the conventional craft knife. Therefore, when using or carrying the conventional craft knife, the handle and the blade box must both be carried which is inconvenient since space in a tool box, tool bag or tool belt is limited and when carried in a tool box or bag, the blade box may open scattering very sharp blades in the box or bag so causing a safety concern.

Furthermore, the conventional craft knife only can used to cut an object, but cannot use to fasten or loosen a nut, bolt or screw so requiring multiple tools to be carried, especially inconvenient when working up ladders or with limited space on a tool belt.

The hand tool for a craft knife in accordance with the present invention mitigates or obviates the aforementioned problems.

SUMMARY OF THE INVENTION

The main objective of the present invention is to provide a hand tool for a craft knife that can be used conveniently.

The hand tool for a craft knife in accordance with the present invention has a handle, at least one blade tray and a connector. The handle has a mounting chamber, a mounting tube, a cap, a socket bit and an ejector tube. The mounting tube is formed on a rear end of the handle. The cap is detachably mounted around the mounting tube. The at least one blade tray is mounted in the mounting chamber and the mounting tube of the handle and has a base and a casing. The base has two mounting protrusions formed on an internal surface of the base. The casing is pivotally mounted in the base and has two mounting holes and a blade chamber. The connector is detachably connected to the handle and has a socket bar, a clamping tube and a pressing tube. The socket bar is detachably mounted in the socket bit. The clamping tube is mounted securely in the socket bar. The pressing tube is mounted around the clamping tube and presses against the socket bar and the clamping tube.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
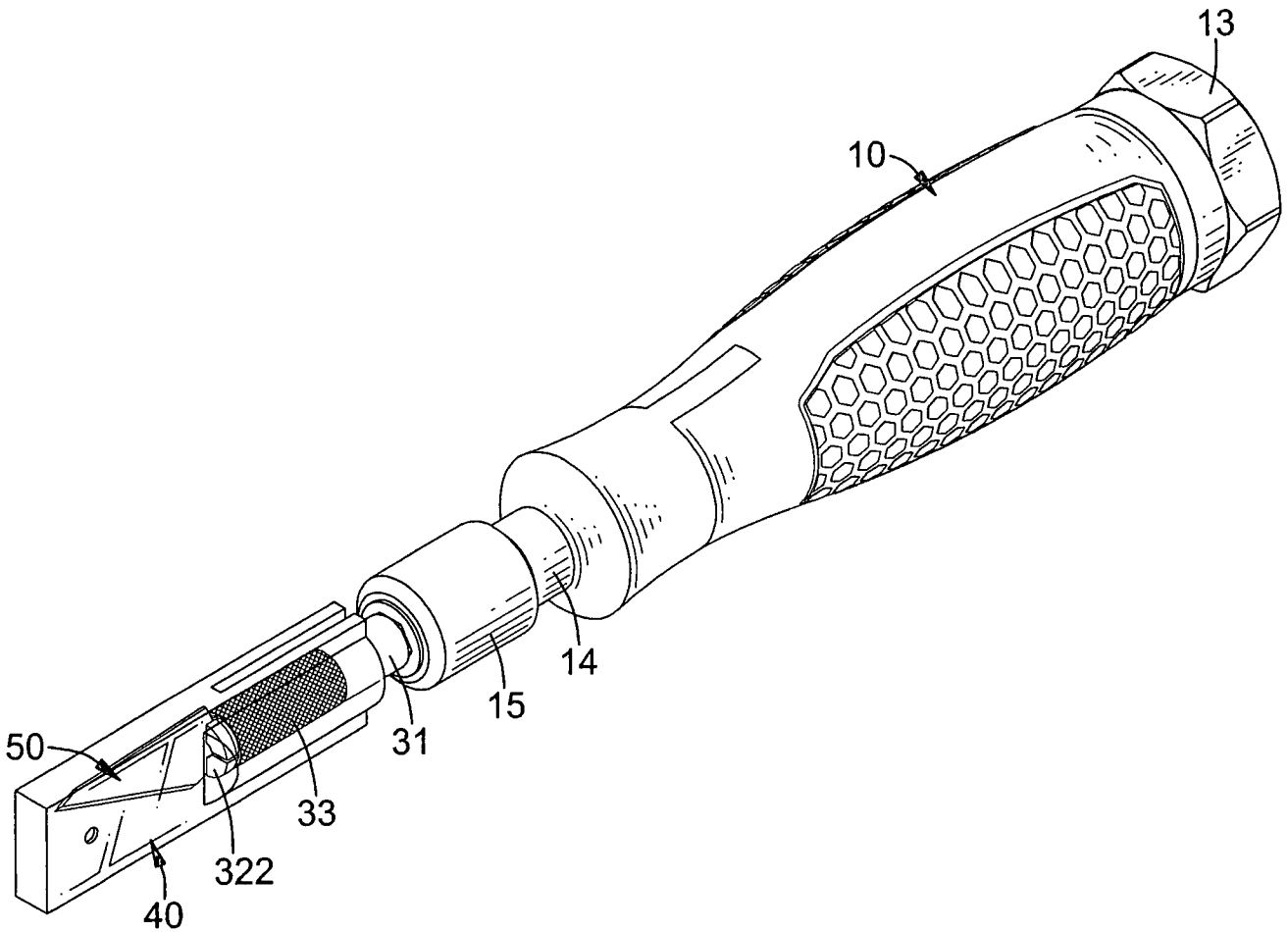
FIG. 1 is a perspective view of a hand tool for a craft knife in accordance with the present invention.
Figure 2:
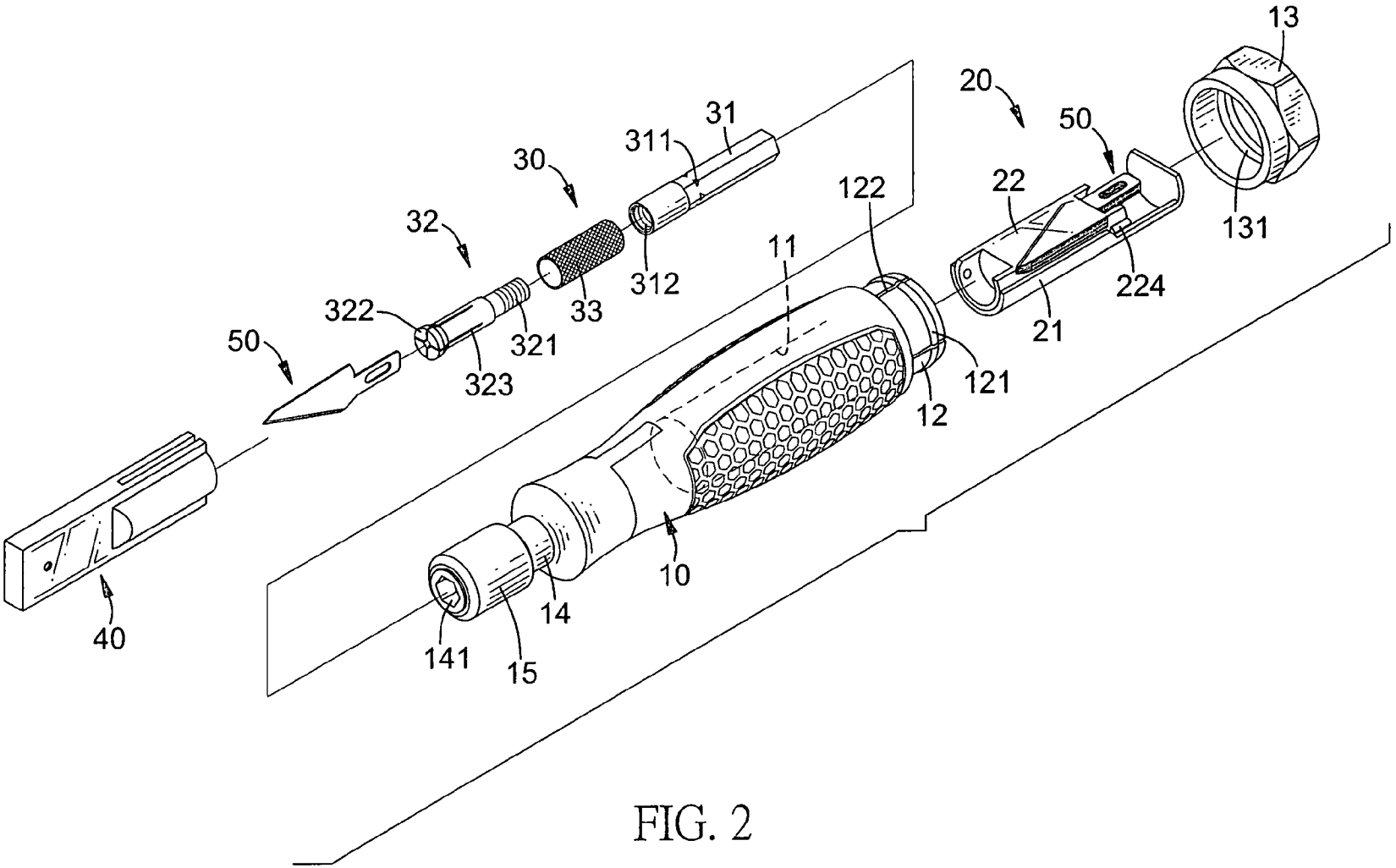
FIG. 2 is an exploded perspective view of the hand tool for a craft knife in FIG. 1.
Figure 3:
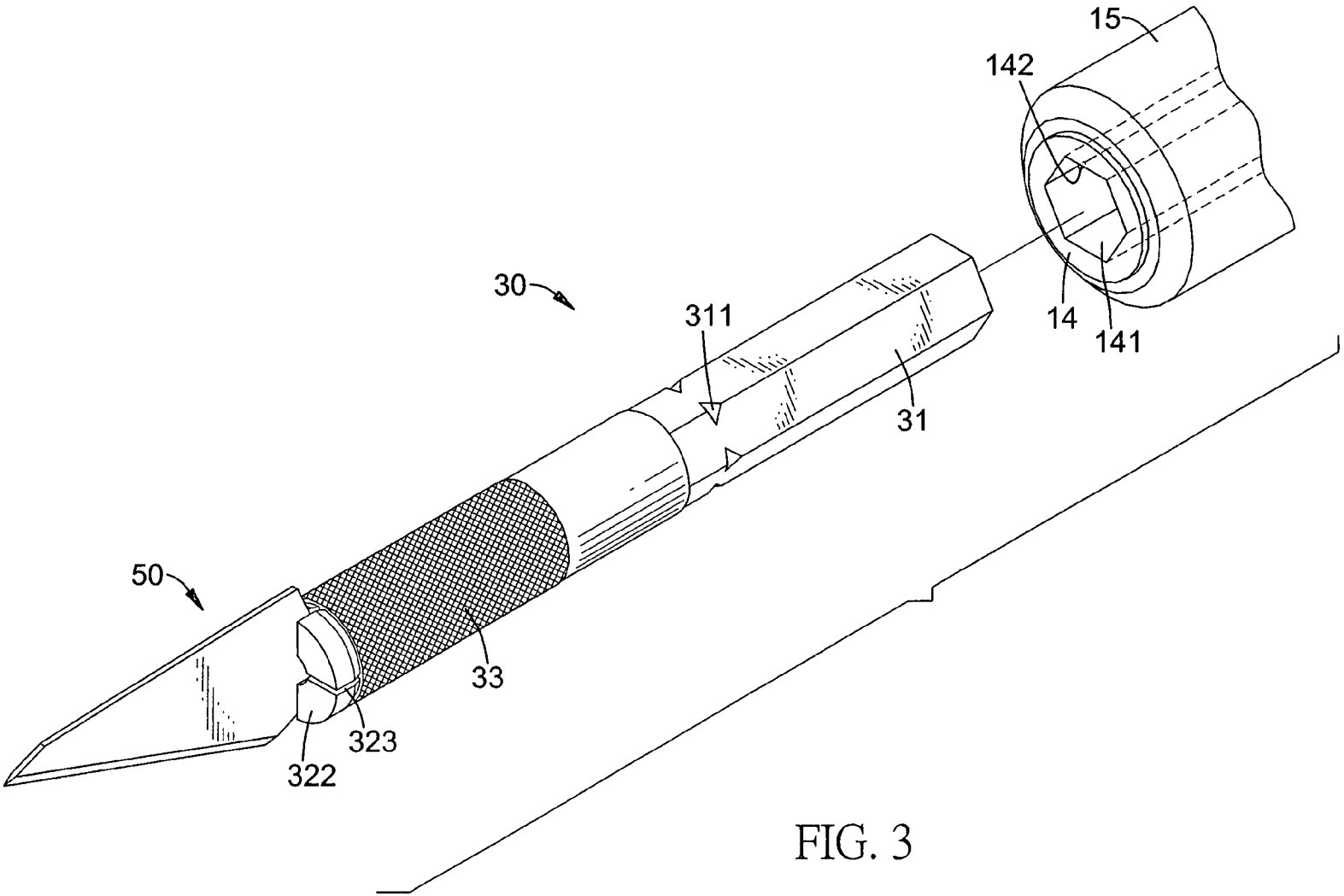
FIG. 3 is an enlarged exploded view of the hand tool in FIG. 1, with a keyed hole shown in phantom lines.
Figure 4:
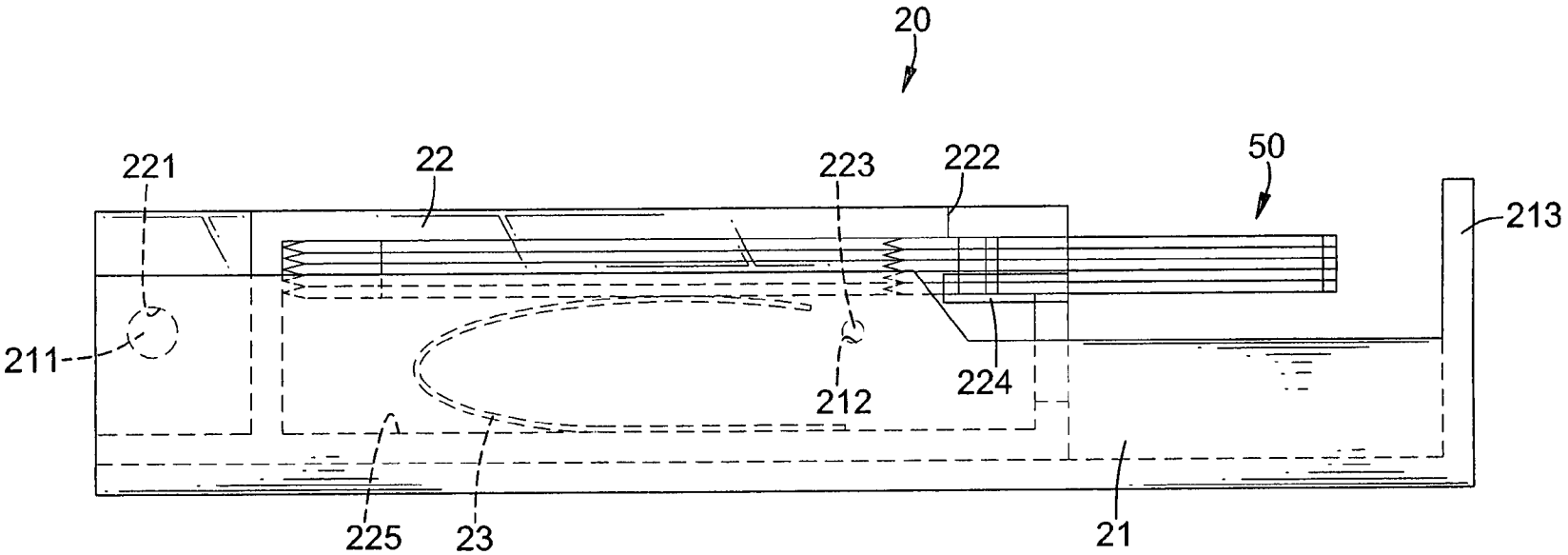
FIG. 4 is an enlarged side view of a blade tray of the hand tool in FIG. 1, with internal elements shown in phantom lines.

With reference to FIGS. 1 to 4, a hand tool for a craft knife in accordance with the present invention comprises a handle (10), a blade tray (20), a connector (30) and a cover (40).

The handle (10) has a front end, a rear end, a mounting chamber (11), a mounting tube (12), a cap (13), a socket bit (14) and an ejector tube (15).

The mounting chamber (11) is defined in the rear end of the handle (10).

The mounting tube (12) is hollow, is formed on and protrudes from the rear end of the handle (10), communicates with the mounting chamber (11) and has an external surface, an inner end, an outer end, an engaging ring (121) and multiple slits (122). The inner end of the mounting tube (12) is formed on the rear end of the handle (10). The engaging ring (121) is formed around the external surface of the mounting tube (12) near the outer end. The slits (122) are individually formed longitudinally through the engaging ring (121) and the external surface of the mounting tube (12) at intervals.

The cap (13) is detachably mounted around the mounting tube (12), abuts the rear end of the handle (10) and has an internal surface and a holding ring (131). The holding ring (131) is formed on the internal surface of the cap (13) and engages the engaging ring (121) of the mounting tube (12) and may be threaded. Therefore, the cap (13) may be pressed onto the mounting tube (12) to be quickly close the mounting chamber (11) but must be screwed off to remove, therefore contents of the mounting chamber (11) can be quickly restrained, but not come out accidentally for improved safety.

The socket bit (14) is formed on and protrudes from the front end of the handle (10) and has a rear end, a front end, an internal surface, a keyed hole (141) and at least one ball (142). The rear end of the socket bit (14) is formed on the front end of the handle (10). The keyed hole (141) may be a hexagon in cross section and is formed in the internal surface of the socket bit (14). The at least one ball (142) is mounted on the internal surface of the socket bit (14), may be mounted on a corner of the hexagon in the keyed hole (141), near the front end of the socket bit (14).

The ejector tube (15) is slidably mounted around the socket bit (14) near the front end.

Figure 5:
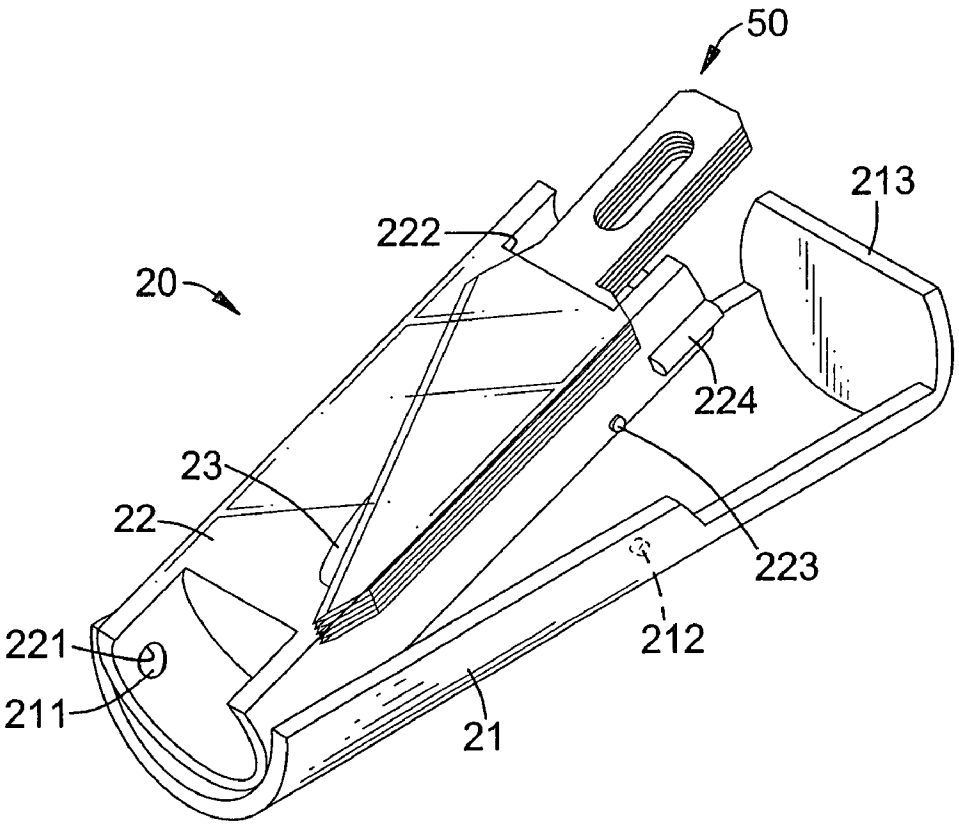
FIG. 5 is an operational perspective view of the blade tray in FIG. 4.

With further reference to FIG. 5, the at least one blade tray (20) is mounted in the mounting chamber (11) and the mounting tube (12) of the handle (10) and each one has a base (21), a casing (22) and a retaining spring (23).

The base (21) may be semi-cylindrical and has an inner end, an outer end, an internal surface, two mounting protrusions (211), two engaging holes (212) and a pulling panel (213). The mounting protrusions (211) are formed on the internal surface of the base (21) near the inner end and face each other. The engaging holes (212) are formed in the internal surface of the base (21) near the outer end and align respectively with the mounting protrusions (211). The pulling panel (213) is formed on and protrudes from the outer end of the base (21).

The casing (22) may be pellucid, is pivotally mounted on the internal surface of the base (21) and has a connecting end, an inserting end, an external surface, two mounting holes (221), an opening (222), two bosses (223), two protrusions (224) and a blade chamber (225). The connecting end of the casing (22) is pivotally connected to the inner end of the base (21). The mounting holes (221) are formed in the connecting end of the casing (22) and are respectively mounted on the mounting protrusions (211) of the base (21). The opening (222) is formed through the inserting end of the casing (22). The bosses (223) are formed on the external surface of the casing (22) and respectively engage the engaging holes (212) of the base (21). The protrusions (224) are formed on the external surface of the casing (22) near the inserting end. The blade chamber (225) is formed in the casing (22) and communicates with the opening (222).

The retaining spring (23) is mounted in the blade chamber (225) of the casing (22) to press and securely hold blades (50) in the blade chamber (225) of the casing (22).

The connector (30) is detachably mounted in the handle (10) and has a socket bar (31), a clamping tube (32) and a pressing tube (33).

The socket bar (31) is detachably mounted in the keyed hole (141) of the socket bit (14), engages the at least one ball (142) and has a front end, a rear end, an external surface, multiple indents (311) and a threaded hole (312). The rear end of the socket bit (31) corresponds to and is mounted in the keyed hole (141) of the socket bit (14). The indents (311) are individually formed on the external surface of the socket bar (31) at intervals and at least one of the indents (311) engages a corresponding ball (142) in the keyed hole (141) to hold the socket bar (31) in the socket bit (14). The threaded hole (312) is formed in the front end of the socket bar (31).

The clamping tube (32) is mounted securely in the threaded hole (312) of the socket bar (31) and has an external surface, a mounting end, a clamping end, an outer thread (321), a collet (322) and multiple slits (323). The outer thread (321) is formed around the external surface of the clamping tube (32) near the mounting end and engages the threaded hole (312) of the socket bar (31). The collet (322) is formed on and protrudes from the clamping end of the clamping tube (32) and has an external surface. The slits (323) are formed longitudinally through the collet (322) and clamping end of the clamping tube (32) at intervals and communicate with each other.

The pressing tube (33) is mounted around the clamping tube (32) and abuts the front end of the socket bar (31) and presses the collet (322) of the clamping tube (32) to hold a blade (50) securely in the slits (323) of the clamping tube (32).

The cover (40) may be pellucid, is detachably mounted around the pressing tube (33) and the clamping tube (32) of the connector (30) to prevent the blade (50) clamped in the slits (323) of the clamping tube (32) from causing injuring.

Figure 6:
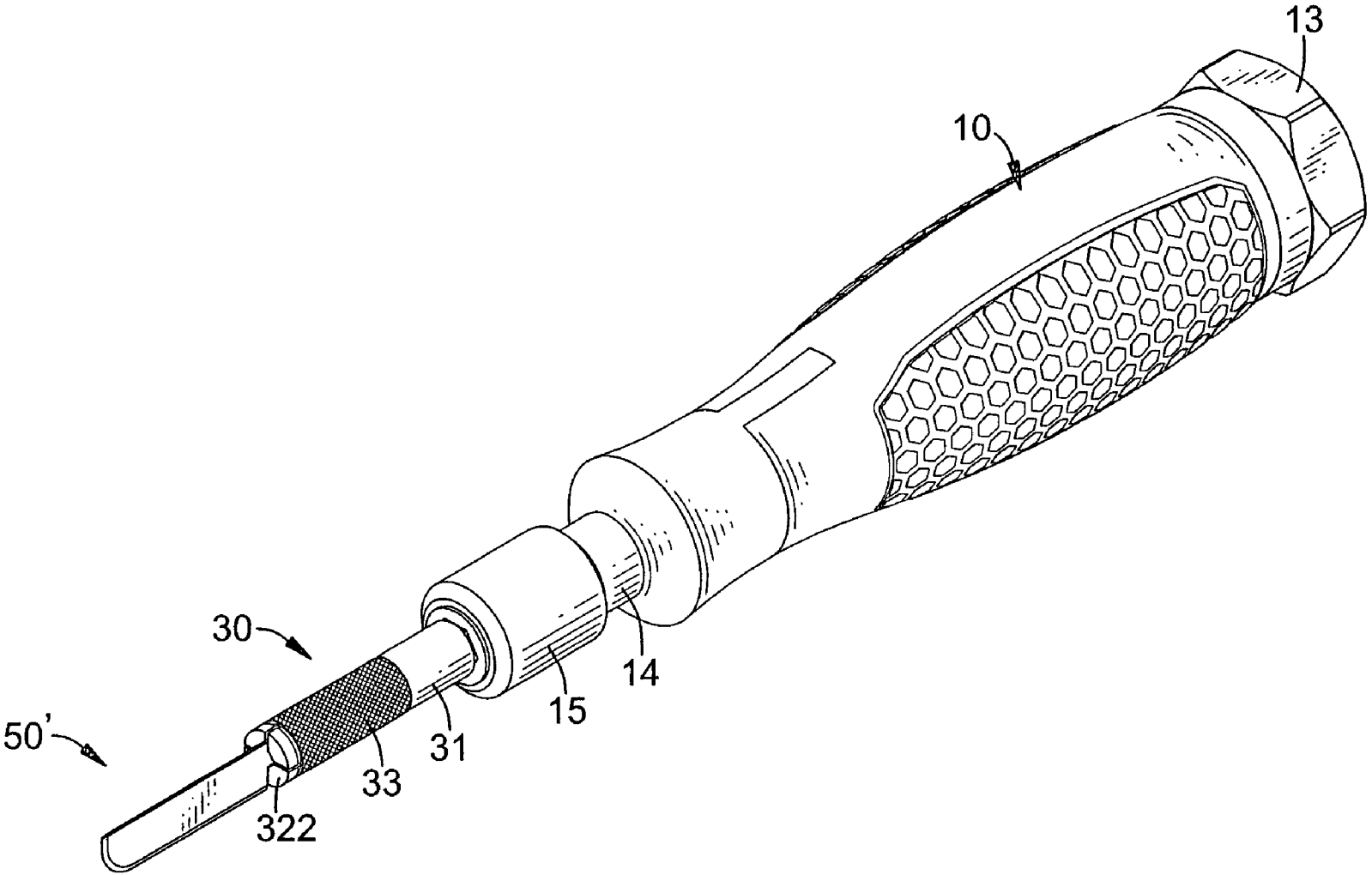
FIG. 6 is another perspective view of the hand tool in FIG. 1 with a second embodiment of blade.

With further reference to FIGS. 5 and 6, the blade (50) clamped in the slits (323) of the clamping tube (32) may be changed with a replacement blade (50) or different type blade (50') from the blade tray (20). Rotating the clamping tube (32) relative to the socket bar (31) releases the clamping tube (32) from the pressing tube (33) and the blade (50) can be removed from the slits (323) of the clamping tube (32). The cap (13) is removed from the mounting tube (12) and the blade tray (20) removed from the mounting chamber (11) of the handle (10) using the pulling panel (213), the casing (22) is rotated relative to the base (21) by pushing the protrusions (224) and the replacement or different type blade (50, 50') is taken out of the blade chamber (225). Before being inserted in the slits (323) of the clamping tube (32) and the clamping tube (32) rotated relative to the socket bar (31) to clamp the blade (50, 50') in the clamping tube (32). Therefore, the replacement or different type knife blade (50, 50') is mounted securely in the clamping tube (32) of the connector (30).

Figure 7:
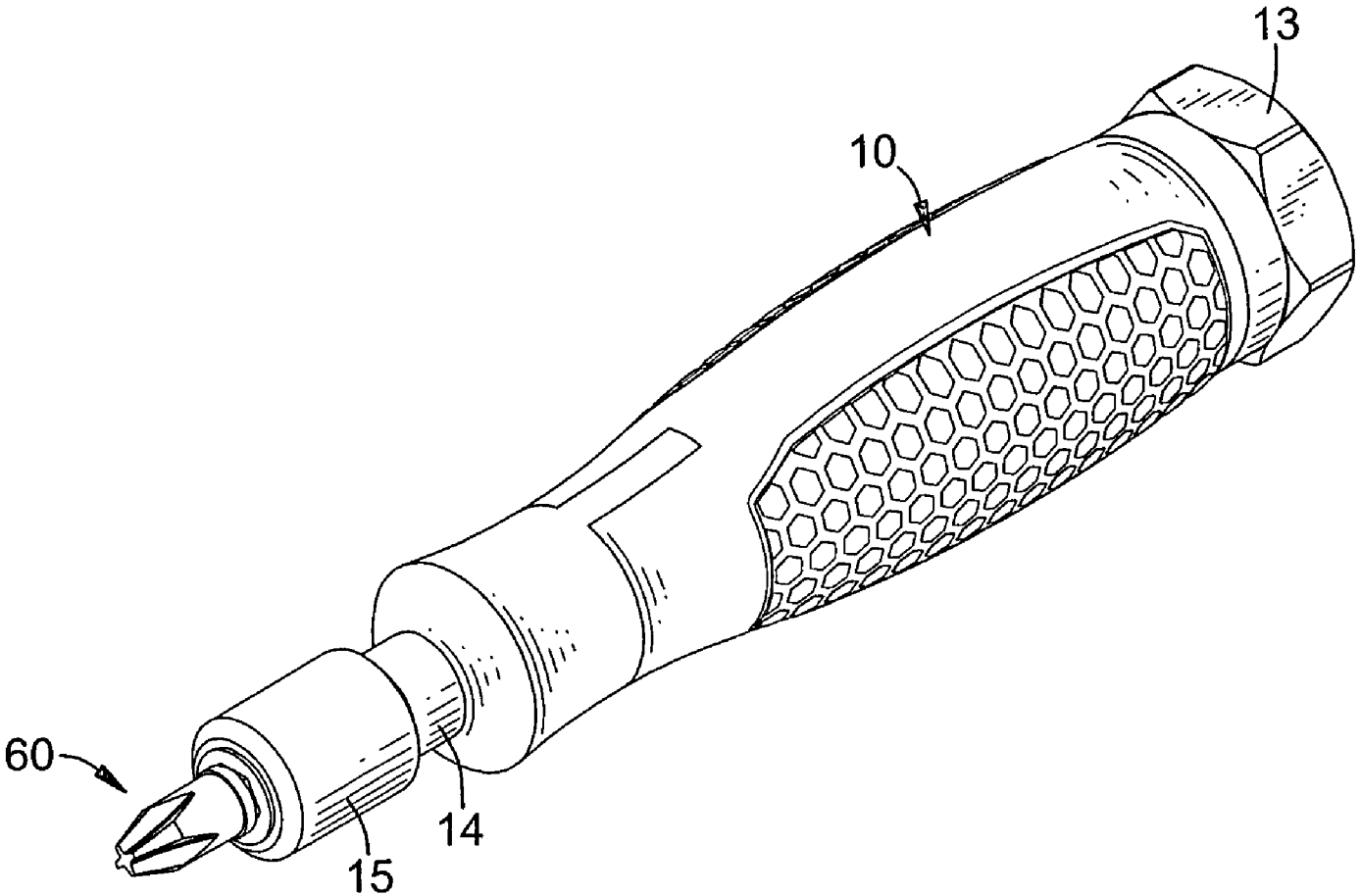
FIG. 7 is an operational perspective view of the hand tool in FIG. 1 with a screw tip.

With further reference to FIG. 7, the hand tool in accordance with the present invention can be used to fasten or loosen a nut, bolt or screw by changing and inserting a socket head (not shown) or a screw tip (60) in the keyed hole (141) of the socket bit (14). Then, the hand tool with the socket head or a screw tip (60) can use to fasten or loosen the nut, bolt or screw.

The hand tool for a craft knife as described has the blade tray (20) mounted in the handle (10) so replacement blades (50) are easily located and carried so are not likely to enter a tool box or the like and cause injury.

Furthermore, the hand tool in accordance with the present invention can be used to fasten or loosen nuts, bolts or screws so the hand tool for a craft knife can be carried.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hand tool for a craft knife having
- a handle having
  - a front end;
  - a rear end;
  - a mounting chamber being defined in the rear end of the handle;
  - a mounting tube being hollow, being formed on and protruding from the rear end of the handle, communicating with the mounting chamber and having
    - an external surface;
    - an inner end being formed on rear end of the handle; and
    - an outer end;
  - a cap being detachably mounted around the mounting tube and abutting the rear end of the handle;
  - a socket bit being formed on and protruding from the front end of the handle and having
    - a rear end being formed on the front end of the handle;
    - a front end;
    - an internal surface; and
    - a keyed hole being formed in the internal surface of the socket bit; and
  - an ejector tube being slidably mounted around the socket bit near the front end of the socket bit;
- a blade tray being mounted in the mounting chamber and the mounting tube of the handle and having
  - a base having
    - an inner end;
    - an outer end;
    - an internal surface; and
    - two mounting protrusions being formed on the internal surface of the base near the inner end and facing each other; and
  - a casing being pivotally mounted on the internal surface of the base and having
    - a connecting end being pivotally connected to the inner end of the base;

an inserting end;
an external surface;
two mounting holes being formed in the connecting end of the casing and being respectively mounted on the mounting protrusions of the base;
an opening being formed through the inserting end of the casing; and
a blade chamber being formed in the casing and communicating with the opening; and
a connector being detachably connected to the handle and having
a socket bar being detachably mounted in the keyed hole of the socket bit and having
a front end;
a rear end corresponding to and being mounted in the keyed hole of the socket bit;
an external surface; and
a threaded hole being formed in the front end of the socket bar;
a clamping tube being mounted securely in the threaded hole of the socket bar and having
an external surface;
a mounting end;
a clamping end; and
an outer thread being formed around the external surface of the clamping tube near the mounting end and engaging the threaded hole of the socket bar; and
a pressing tube being mounted around the clamping tube and pressing against front end of the socket bar and the clamping end of the clamping tube to hold a blade in the clamping tube.

2. The hand tool for a craft knife as claimed in claim 1, wherein the hand tool further has a cover being detachably mounted around the pressing tube and the clamping tube of the connector.

3. The hand tool for a craft knife as claimed in claim 2, wherein
the socket bit further has a ball being mounted on the internal surface of the socket bit near the front end of the socket bit; and
the socket bar further has multiple indents being individually formed on the external surface of the socket bar at intervals and one of the detents engaging the ball in the keyed hole to hold the socket bar in the socket bit.

4. The hand tool for a craft knife as claimed in claim 3, wherein the ball of the socket bit is mounted on a corner of the keyed hole.

5. The hand tool for a craft knife as claimed in claim 4, wherein
the mounting tube of the handle further has
an engaging ring being formed around the external surface of the mounting tube near the outer end of the mounting tube; and
multiple slits being individually formed longitudinally through the engaging ring and the external surface of the mounting tube at intervals; and
the cap of the handle further has
an internal surface; and
a holding ring being formed on the internal surface of the cap and engaging the engaging ring of the mounting tube.

6. The hand tool for a craft knife as claimed in claim 5, wherein the blade tray further has a retaining spring being mounted in the blade chamber of the casing to press and securely hold blades in the blade chamber of the casing.

7. The hand tool for a craft knife as claimed in claim 6, wherein
the base further has
two engaging holes being formed in the internal surface of the base near the outer end and aligning respectively with the mounting protrusions; and
a pulling panel being formed on and protruding from the outer end of the base; and
the casing further has
two bosses being formed on the external surface of the casing and respectively engaging the engaging holes of the base; and
two protrusions being formed on the external surface of the casing near the inserting end of the casing.

8. The hand tool for a craft knife as claimed in claim 7, wherein clamping tube further has
a collet being formed on and protruding from the clamping end of the clamping tube and having an external surface; and
multiple slits being formed longitudinally through the collet and clamping end of the clamping tube at intervals and communicating with each other.

9. The hand tool for a craft knife as claimed in claim 8, wherein
the base is semi-cylindrical; and
the casing is pellucid; and
the cover is pellucid.

10. The hand tool for a craft knife as claimed in claim 9, wherein
the keyed hole is a hexagon in cross section; and
the ball is mounted on a corner of the hexagon.

11. The hand tool for a craft knife as claimed in claim 1, wherein
the socket bit further has a ball being mounted on the internal surface of the socket bit near the front end of the socket bit; and
the socket bar further has multiple indents being individually formed on the external surface of the socket bar at intervals and one of the detents engaging the ball in the keyed hole to hold the socket bar in the socket bit.

12. The hand tool for a craft knife as claimed in claim 11, wherein the ball of the socket bit is mounted on a corner of the keyed hole.

13. The hand tool for a craft knife as claimed in claim 1, wherein
the mounting tube of the handle further has
an engaging ring being formed around the external surface of the mounting tube near the outer end of the mounting tube; and
multiple slits being individually formed longitudinally through the engaging ring and the external surface of the mounting tube at intervals; and
the cap of the handle further has
an internal surface; and
a holding ring being formed on the internal surface of the cap and engaging the engaging ring of the mounting tube.

14. The hand tool for a craft knife as claimed in claim 1, wherein the blade tray further has a retaining spring being mounted in the blade chamber of the casing to press and securely hold blades in the blade chamber of the casing.

15. The hand tool for a craft knife as claimed in claim 1, wherein
the base further has
two engaging holes being formed in the internal surface of the base near the outer end and aligning with the mounting protrusions; and a pulling panel being formed on and protruding from the outer end of the base; and the casing further has two bosses being formed on the external surface of the casing and respectively engaging the engaging holes of the base; and two protrusions being formed on the external surface of the casing near the inserting end of the casing.

16. The hand tool for a craft knife as claimed in claim 1, wherein clamping tube further has a collet being formed on and protruding from the clamping end of the clamping tube and having an external surface; and multiple slits being individually formed longitudinally through the collet and clamping end of the clamping tube at intervals.

17. The hand tool for a craft knife as claimed in claim 1, wherein the base is semi-cylindrical; and the casing is pellucid; and the cover is pellucid.

18. The hand tool for a craft knife as claimed in claim 1, wherein the keyed hole is a hexagon in cross section; and the ball is mounted on a corner of the hexagon.

* * * * *